US005289618A

United States Patent [19]

Fehrer

[11] Patent Number: 5,289,618

[45] Date of Patent: Mar. 1, 1994

[54] APPARATUS FOR MAKING A NONWOVEN WEB

[76] Inventor: Ernst Fehrer, Auf der Gugl 28, A-4020 Linz (Österreich), Austria

[21] Appl. No.: 983,760

[22] Filed: Dec. 1, 1992

[30] Foreign Application Priority Data

| | | | |
|---|---|---|---|
| Dec. 5, 1991 | [AT] | Austria | A 2418/91 |
| Oct. 2, 1992 | [AT] | Austria | A 1944/92 |
| Oct. 12, 1992 | [AT] | Austria | A 2002/92 |

[51] Int. Cl.[5] ..... D01G 25/00

[52] U.S. Cl. ..... 19/304; 19/296; 19/145.7; 19/99

[58] Field of Search ..... 19/99, 106 R, 147.5, 19/296, 302, 304

[56] References Cited

U.S. PATENT DOCUMENTS

| | | | |
|---|---|---|---|
| 3,641,628 | 2/1972 | Fehrer | 19/156.4 |
| 3,914,822 | 10/1975 | Wood | 19/302 X |
| 3,963,392 | 6/1976 | Goyal | 19/302 X |
| 4,315,347 | 2/1982 | Austin et al. | 19/145.7 |
| 4,712,277 | 12/1987 | Gustavsson | 19/296 |
| 5,007,137 | 4/1991 | Graute | 19/145.7 X |
| 5,117,535 | 6/1992 | Fehrer | 19/99 |

*Primary Examiner*—Peter Nerbun
*Assistant Examiner*—John J. Calvert
*Attorney, Agent, or Firm*—Collard & Roe

[57] ABSTRACT

An apparatus for making a nonwoven web has a carding drum (1), a continuously moving, air-permeable collecting surface member (2) for collecting fibers which fly in an entraining air stream from the carding drum (1), a suction box (4), connected to the collecting surface member (2), and a suction duct (3) extending between the collecting surface member and a peripheral portion of the carding drum (1) which is directly opposite to the collecting surface member (2). In order to ensure desirable conditions of flow in the suction duct (3), air supply passages (10, 11) extend over the working width of the carding drum (1) in the region in which the carding drum (1) is adjacent to leading and trailing suction duct walls (3*a* and 3*b*), with respect to the direction of rotation of the carding drum (1), and the air supply passag extend between the carding drum (1) and two drum guards (12 and 13), which respectively extend opposite to the direction of rotation of the drum from the leading duct wall (3*a*) and in the direction of rotation of the drum from the trailing duct wall (3*b*).

2 Claims, 2 Drawing Sheets 1
2
3
3a
3b
4
4a
5
6
7
8
9
9
10
11
12
13

APPARATUS FOR MAKING A NONWOVEN WEB

BACKGROUND OF THE INVENTION

1. Field of the Invention

This invention relates to an apparatus for making a nonwoven web comprising a carding drum, a continuously moving, air-permeable collecting surface member for collecting fibers which fly in an entraining air stream from the carding drum, a suction box, which is connected to the collecting surface member on that side thereof which is opposite to the carding drum, and a suction duct between the carding drum and the collecting surface.

2. Description of the Prior Art

To make a nonwoven web from a lap, it is known from U.S. Pat. No. 3,641,628 to disintegrate the lap by means of a carding drum into individual fibers and to blow off the covering formed by the individual fibers under the action of centrifugal force by means of an entraining air stream which is tangential to the carding drum so that the nonwoven web is formed in that the individual fibers are deposited on a collecting surface member, which is disposed below the carding drum and is continuously moved and through which the air stream is sucked. Said apparatuses have the disadvantage that the individual fibers cannot be deposited on the collecting surface as uniformly as desired, particularly if the fibers are supplied at a high rate, because the length of the flight path for the fibers between the region in which they are detached from the carding drum and the region in which they impinge on the collecting surface member necessarily depends on the diameter of the carding drum so that there is a considerable risk of formation of lumps, particularly if the working width is large. This is due to the fact that large working widths require carding drums which are large in diameter so that the fibers fly over larger distances.

To ensure a uniform detaching of the fibers from the carding drum and an undisturbed deposition of the fibers on the collecting surface member, it has been proposed to provide between the carding drum and the collection surface a plurality of suction ducts, which are consecutively arranged in the direction of rotation of the carding drum and extend substantially radially with respect to the carding drum so that the individual fibers into which the lap has been disintegrated by the carding drum can be divided into a plurality of partial streams of fibers, which are consecutively deposited on the collecting surface member. Because fibers at a correspondingly lower rate are conveyed in each of said partial streams of fibers, the tendency of a formation of lumps is greatly reduced. But a higher expenditure is involved in the detaching of the fibers from the carding drum in separate layers for the formation of a plurality of partial streams of fibers.

SUMMARY OF THE INVENTION

For this reason it is an object of the invention so to design an apparatus which is of the kind described first hereinbefore and serves to make a nonwoven web that desirable conditions are ensured for the detaching of the fibers from the carding drum and that a formation of lumps by the fibers can be avoided.

The object set forth is accomplished in accordance with the invention in that the suction duct adjoins the carding drum in a peripheral portion thereof which is directly opposite to the collecting surface member, and that air supply passages for supplying air to the suction duct extend over the working width of the carding drum in the region in which the carding drum is adjointed by leading and trailing duct walls, with respect to the direction of rotation of the carding drum, and extend between the carding drum and two drum guards, which respectively extend opposite to the direction of rotation of the drum from the leading duct wall and in the direction of rotation of the drum from the trailing duct wall.

Because the suction duct extends between the collecting surface member and a peripheral portion of the carding drum which is directly opposite to the collecting surface member, the length of that suction duct and, as a result, the length of the path for the entraining air, can be selected independently of the diameter of the drum which is required in each case. A vertical plane extends through the axis of the carding drum and intersects the fiber collecting member at a web forming locus. For this reason it is possible even if the drum is large in diameter to restrict the average length of the flight path for the fibers to an extent by which a risk of formation of lumps is substantially precluded. For the making of a nonwoven web of random fibers having no preferential direction it is necessary that the fibers flying from the carding drum to the collecting surface member are not subjected to centrifugal forces, which would adversely affect the random deposition of the fibers. For this reason the entraining air stream must not be accelerated toward the collecting surface member. That requirement can desirably be met by means of a suction duct, which adjoins the carding drum at a peripheral portion which is directly opposite to the collecting surface member because the conditions of flow in such ducts can be defined by a suitable design if a sufficient entraining air stream is ensured by the provision of lateral air supply passages, which extend over the working width of the carding drum and ensure and adequate entraining air stream, which is sucked only by the suction box associated with the collecting surface member. In that context it is mainly essential to provide the partial air stream which is sucked through the air supply passage adjacent to the trailing duct wall and which assists the detaching of the fibers from the carding drum without a formation of lumps and causes the fibers to be deflected toward the suction duct. For that purpose the air supply passage provided adjacent to the trailing duct wall is defined by the carding drum and a drum guard, which adjoins the trailing duct wall and extends therefrom in the direction ot rotation of the drum. As a result, the air flows opposite to the direction of rotation of the drum in that air supply passage so that any fibers carried by the carding drum out of the region of the radial suction passage will reliably be detached and said fibers will then be entrained into the suction duct by the entraining air stream which flows oppositely to the direction of rotation of the drum.

Because the air is also sucked adjacent to the leading duct wall in the air supply passage between a drum guard and the carding drum, the fibers can be detached at an early time adjacent to that air supply passage. This results in particularly desirable conditions for the detaching so that the inclination of the leading faces of the teeth of the carding drum can be increased and the carding action of the carding drum can thus be appreciably improved.

The inflowing air which flows in the suction duct opposite to the direction of rotation of the carding drum and is mixed with the inflowing air which flows in the direction of rotation of the drum should not adversely affect the conveyance of the fibers within the suction duct. This is ensured according to a further feature of the invention in that the suction duct extending from the air supply passages is initially tapered like a nozzle adjacent to the leading and trailing duct walls and is subsequently expanded like a diffuser toward the collecting surface member. That measure will assist in the first place, a mixing of the two streams of inflowing air in the nozzlelike tapering portion of the suction duct so that an entraining air stream which is uniformly laden with fibers is conducted through the succeeding portion of the duct, which owing to its diffuserlike expansion ensures not only a substantially nonturbulent conveyance of the fibers but also calms the conditions of flow; this is of considerable importance for the random deposition of the fibers because for that purpose any directive actions on the fibers should be avoided as far as possible. Such directive actions must always be expected when the entraining air stream is accelerated.

DETAILED DESCRIPTION OF THE PREFERRED EMBODIMENT

Figure 1:
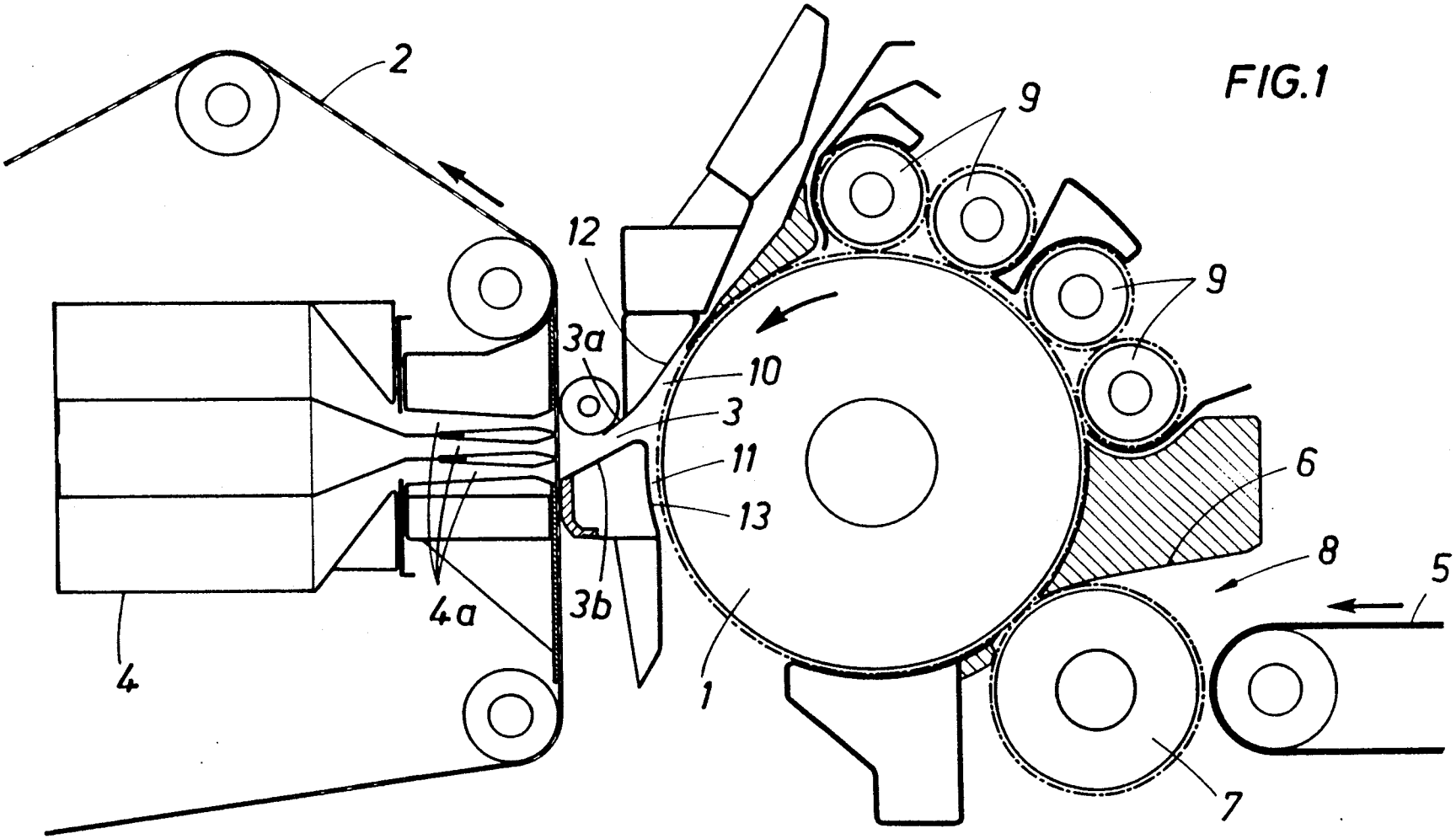
FIG. 1 is a schematic longitudinal sectional view showing an apparatus according to the invention for making a nonwoben web.

An illustrative embodiment of the invention will now be explained with reference to the drawing.

The illustrated apparatus for making a nonwoven web essentially comprises a carding drum 1, which is provided with a seratted surface, a continuously moving, air-permeable collecting surface member 2, which is radially spaced from the carding drum 1, and a suction duct 3, which extends between the collecting surface member 2 and a portion of the periphery of the carding drum 1 which is directly opposite to the collecting surface member 2. A suction box 4 is provided on that side of the collecting surface member 2 which is opposite to the carding drum. That suction box causes the entraining air to be sucked from the suction duct 3 through the collecting surface member 2.

The fibrous fleece is fed in a usual manner by a conveying belt 5 to a charging station 8 associated with the carding drum 1. That charging station 8 consists of a table 6 and a feed roller 7. The fleece is disintegrated into individual fibers as it is fed. The charging station 8 is succeeded in the direction of rotation of the carding drum 1 by pairs of worker and clearer rolls 9, by which the fibrous layer on the carding drum is made more uniform; that fibrous layer is subsequently delivered to the suction duct 3.

The entraining air forming the suction stream through the suction duct 3 is sucked through air supply passages 10 and 11, which are associated with the leading duct wall **3*a* and the trailing duct wall 3*b*, respectively, and extend between the carding drum 1 and drum guards 12 and 13. In cooperation with the centrifugal forces exerted on the fibers, the air streams through the air supply passages 10 and 11 cause individual fibers to be detached from the carding drum 1 and to be conveyed to the collecting surface member 2. For a uniform deposition of the fibers on the collecting surface member 2 it is essential that the fibers are detached without a disturbance from the carding drum 1 and are subsequently conveyed without a disturbance within the suction duct 3. The detaching of the singled fibers from the carding drum 1 by centrifugal forces is assisted particularly by the stream of incoming air flowing through the air supply passage 10 before that air reaches the suction duct 3**.

Adjacent to the duct wall **3*b*, the air stream which has entered through the air supply passage 11 flows along the outside periphery of the carding drum 1 opposite to the direction of rotation of the drum to the suction duct 3 so that any residual fibers, which have been carried by the carding drum 1 out of the region of the suction duct 3, will be detached from the carding drum and returned into the suction duct 3 under the action of that oppositely directed air stream. That incoming air sucked through the air supply passage 11 also assists the deflecting of the fibers toward the suction duct 3**.

Figure 2:
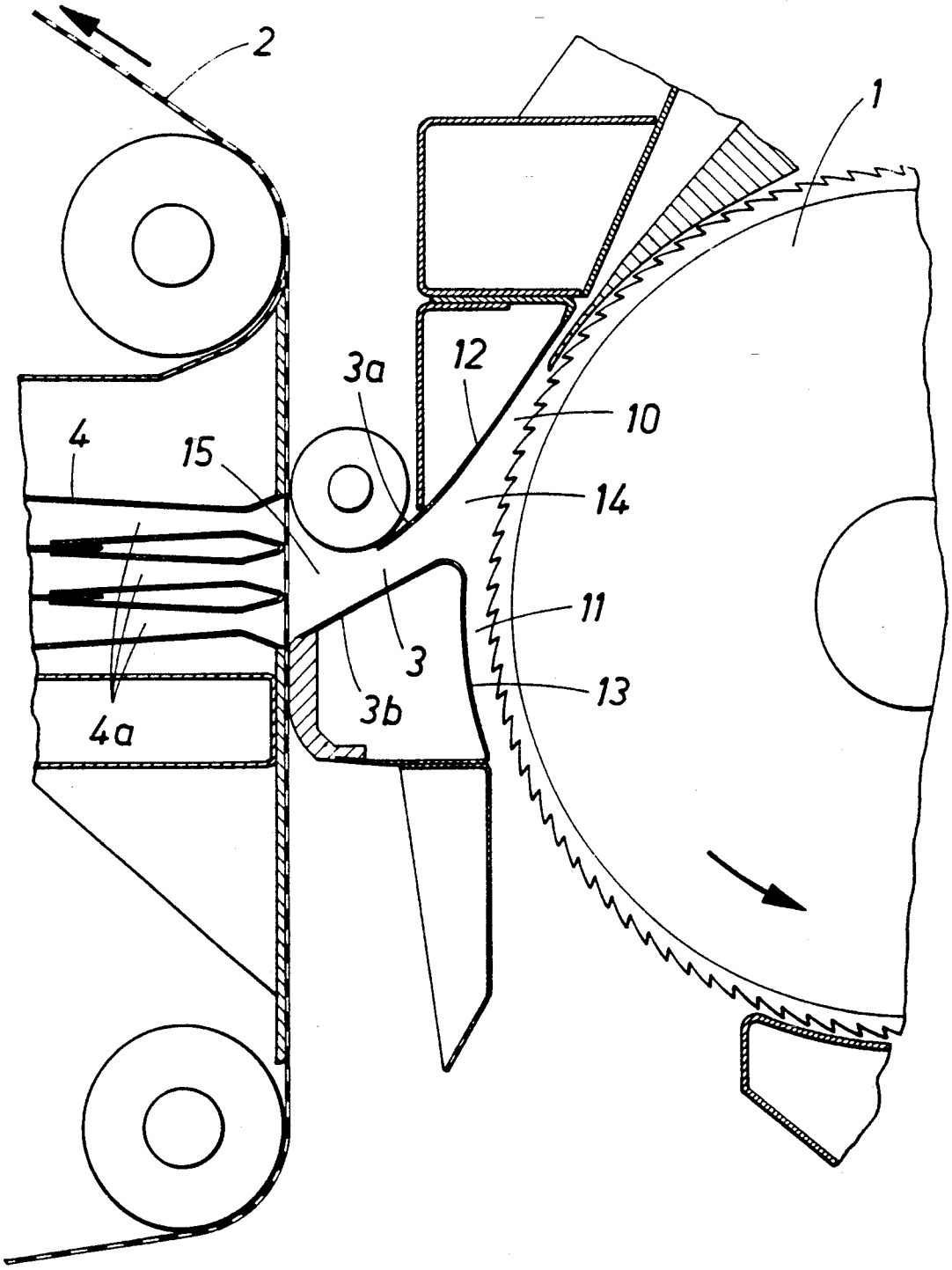
FIG. 2 is a fragmentary enlarged sectional view taken on a plane through the suction duct of that apparatus.

To enable the fibers which have been conveyed to the collecting surface member 2 by the entraining air stream, which is composed of the incoming air streams entering through the passages 10 and 11, to be deposited on the collecting surface member 2 in a random distribution without a permitted because. This is permitted because the suction duct 3 is tapered like a nozzle in an upstream portion in which the two incoming air streams are mixed and after the nozzlelike constriction has a downstream portion, which expands toward the collecting surface member 2. This is particularly apparent from FIG. 2, in which the tapered nozzlelike duct portion is designated 14 and the duct portion which expands like a diffuser is designated 15. That design of the duct results in a desirable mixing of the two air streams flowing in mutually opposite directions, before the common entraining air stream formed by said air streams is sucked through the collecting surface member 2. Owing to the diffuserlike expansion of the duct that common entraining air stream is calmed and this will assist the random deposition of the fibers. The risk of a formation of lumps is very low because the flow is substantially laminar.

To ensure a uniform deposition of the fibers, the entraining air stream must properly be sucked through the collecting surface member 2. For that purpose the suction stream is adjusted by dividing the suction box 4 into separate suction box sections **4*a*, which succeed each other in the direction of movement of the collecting surface member and which may be subjected at least in groups to different negative pressures. Owing to the different suction forces exerted in the different suction box sections 4*a*, the suction streams act adjacent to the suction zone through the collecting surface member 2 with different intensities on the entraining air stream in the suction duct 3 so that a substantially laminar flow can be achieved also adjacent to the collecting surface member 2** if the flow is properly distributed.

I claim:

1. An apparatus for making a nonwoven web, comprising (a) a carding drum having an axis and a predetermined working width and operable to rotate in a predetermined direction, (b) a continuously movable, air-permeable fiber collecting member radially spaced from a peripheral portion of the carding drum, the fiber collecting member having a fiber collecting surface facing the peripheral carding drum portion and a surface opposite the fiber collecting surface, wherein a vertical plane extending through the axis of the carding drum intersects said fiber collecting member at a web forming locus, (c) a suction duct leading from the peripheral carding drum portion to the fiber collecting surface, the suction duct being defined between (1) a duct wall leading with respect to the direction of rotation of the carding drum and (2) a duct wall trailing with respect to the direction of rotation of the carding drum, (d) two carding drum guards extending over the working width of the carding drum, (1) a leading one of the drum guards extending from the leading duct wall in a direction opposite to the direction of rotation of the carding drum and (2) a trailing one of the drum guards extending from the trailing duct wall in the direction of rotation of the carding drum, (3) the carding drum guards defining air supply passages with the peripheral carding drum portion, the air supply passages extending over the working width of the carding drum and opening into the suction duct, and (e) a suction box adjoining the opposite surface of the fiber collecting member and operable to suck a fiber entraining air stream through the air supply passages, the suction duct and the air-permeable fiber collecting member to detach fibers from the peripheral carding drum portion and to deposit the detached fibers on the fiber collecting surface to form said nonwoven web.

2. The apparatus of claim 1, wherein the duct walls define a constricted upstream portion of the suction duct adjacent the air supply passages and a downstream portion expanding towards the fiber collecting surface.

* * * * *